US005740569A

United States Patent [19]

Gurries, II et al.

[11] Patent Number: 5,740,569

[45] Date of Patent: Apr. 21, 1998

[54] EMERGENCY EYEWASH UNIT

[75] Inventors: Albert G. Gurries, II, Reno; Sam T. Hong, Sparks, both of Nev.

[73] Assignee: Haws Company, Sparks, Nev.

[21] Appl. No.: 805,929

[22] Filed: Feb. 25, 1997

[51] Int. Cl.[6] ..... A61H 33/00

[52] U.S. Cl. ..... 4/620; 4/624

[58] Field of Search ..... 4/620, 624, 625, 4/626, 900; 239/590, 553, 543

[56] References Cited

U.S. PATENT DOCUMENTS

| | | | |
|---|---|---|---|
| 2,999,249 | 9/1961 | Logan et al. | 4/620 |
| 3,106,722 | 10/1963 | Logan et al. | 4/620 |
| 4,675,924 | 6/1987 | Allison et al. | 4/620 |
| 5,008,963 | 4/1991 | Stein . | |
| 5,530,972 | 7/1996 | Tanner . | |

*Primary Examiner*—David J. Walczak

*Attorney, Agent, or Firm*—Kelly Bauersfeld Lowry & Kelley, LLP

[57] ABSTRACT

An emergency eyewash unit is provided for installation on a counter top adjacent to a sink, and includes a pair of spray heads mounted on a common swing arm for movement between a stored position alongside the sink and an active position with the spray heads disposed over the sink. The swing arm is mounted to the counter top by a control valve assembly which opens as the swing arm is moved to the active position to connect the spray heads to a water supply. The eyewash unit includes an adjustable cam mechanism with a set screw which cooperates with a selected one of a pair of cam tracks formed on the control valve to define a limited range of swing arm travel between the stored and active positions, wherein the set screw is quickly and easily mounted within a selected on of a pair of threaded ports to accommodate mounting of the eyewash unit on the left or right sides of the sink.

14 Claims, 4 Drawing Sheets

FIG. 2
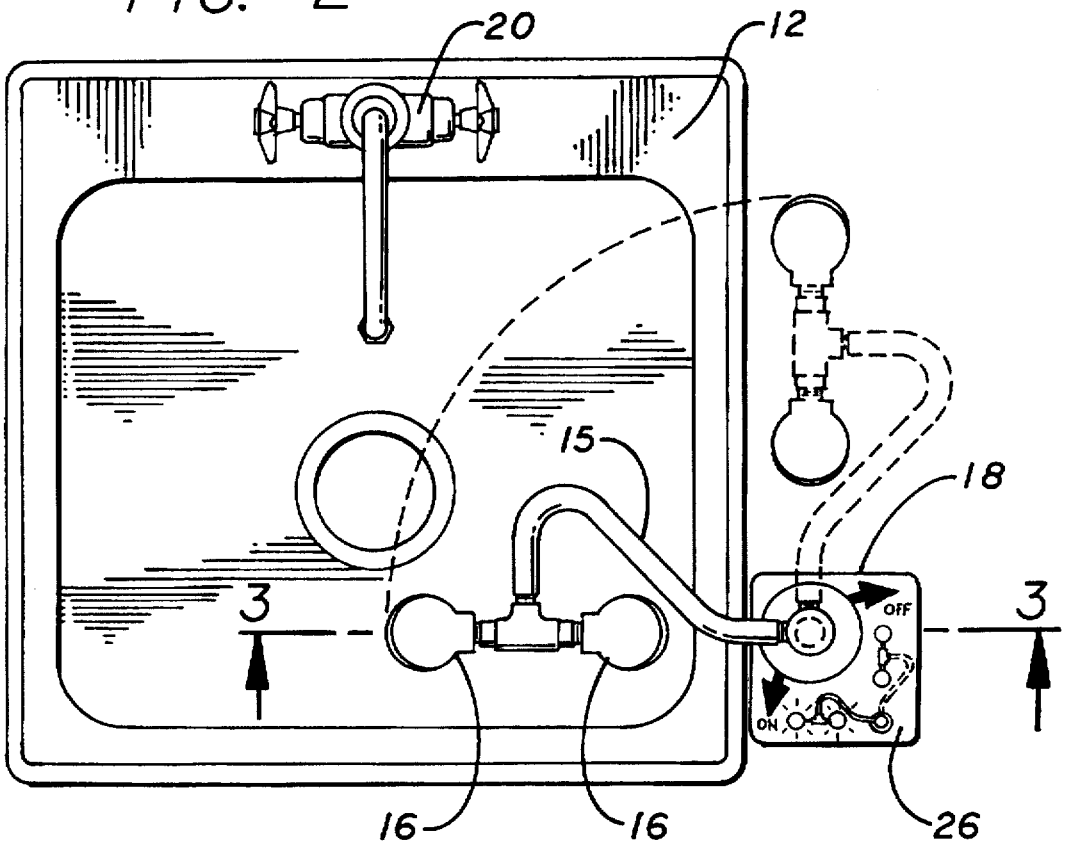
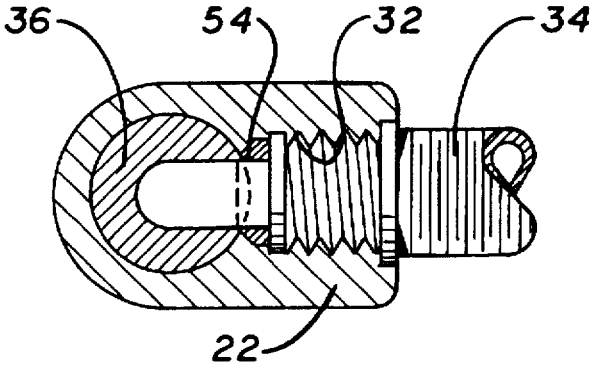
FIG. 4
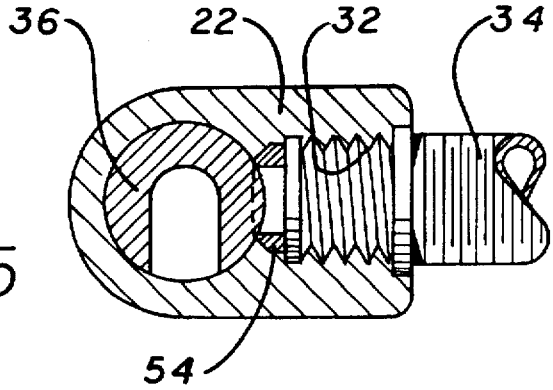
FIG. 5

EMERGENCY EYEWASH UNIT

BACKGROUND OF THE INVENTION

This invention relates generally to emergency eyewash stations designed particularly for use in a laboratory or industrial environment to provide a flush flow of water to remove irritants or contaminants from a person's eyes. More specifically, this invention relates to an improved emergency eyewash unit adapted for selective reversible installation at the left or right sides of a sink.

Emergency eyewash stations are generally known in the art for use in washing or flushing toxic substances from a person's eyes and face. Such eyewash stations are commonly used in laboratory and industrial applications wherein personnel are required to handle substances which can be potentially harmful if contacted with the eyes. A typical eyewash station includes one or more spray nozzles or spray heads mounted over or in close association with an appropriate sink or drain, with means for rapidly and easily opening a valve to provide a flushing flow of water to and through the spray heads. The spray heads are oriented to provide a flushing flow of water to the eyes and face to flush irritants and contaminants therefrom.

In the past, many eyewash stations have been developed for dedicated emergency use, and adapted to be mounted in a location close to the handling site of potentially toxic substances. In some cases, the spray heads are mounted in a fixed position over an associated sink or the like, and the station is activated by opening a water flow control valve, typically provided in the form of a simple push flag. See, for example, U.S. Pat. No. 5,008,963. In other cases, the spray heads are mounted on a movable manifold or swing arm structure that is normally shifted through a part-circle rotation of about ninety degrees between an out-of-the-way stored position for normal unobstructed use of the sink or basin, and an active position with the spray heads located over the sink when needed for emergency eye flushing. In an optimum form, such movable swing arm devices have incorporated a control valve that is turned on and off in response to swing arm motion, so that the eyewash unit can be activated with a single motion of the swing arm. However, to accommodate reversible mounting of the swing arm device at either the left or right side of a sink, prior swing arm units have typically required a structure that permitted full circle swing arm rotation, or alternately required different manufactured components in order to accommodate selective mounting of the swing arm and spray heads at the left or right side of a sink. More recently, an alternative swing arm configuration has been provided wherein the swing arm can be reversibly mounted, but significant disassembly and re-assembly of the unit is necessary in order to accomplish this purpose. See, for example, U.S. Pat. No. 5,530,972.

The present invention provides an improved emergency eyewash station or unit of the type adapted for mounting alongside a sink or basin, but wherein the eyewash unit can be reversibly mounted at the left or right side of the sink with the appropriate part-circle swing arm rotation, but without necessitating special manufactured components or significant re-assembly of the unit to permit reversible installation.

SUMMARY OF THE INVENTION

In accordance with the invention, an improved emergency eyewash unit is provided for reversible installation alongside a sink or basin or the like, and for appropriate part-circle rotation of a swing arm for opening a control valve and also for orienting a pair of spray heads in an active position with a single motion. The eyewash unit of the present invention includes adjustment means for quickly and easily configuring the unit for installation at the left or right side of the sink, as may be best suited for a particular location or application, without requiring any significant disassembly or re-assembly of components to accommodate reversible installation.

In the preferred form of the invention, the eyewash unit comprises a valve body adapted for secure mounting onto the counter top adjacent to a sink at the left or right side of the sink. The valve body includes an inlet fitting for appropriate connection to a water supply line. An upper end of the valve body is upwardly open above the counter top for slide-in reception of a valve spool rotatably received into the valve body. A radially open inlet port is formed in the valve spool near a lower end thereof for selective alignment with the inlet fitting to receive water flow therefrom, and the upper end of the valve spool is connected to the swing arm which in turn carries the pair of spray heads thereon.

A lower end of the valve spool comprises a cam segment fitted into a lower cavity formed in the valve body, wherein this cam segment has a pair of radially outwardly open cam tracks of limited arcuate width formed therein. The adjustment means comprises at least one set screw threadably carried by the valve body for advancement Into a selected one of these cam tracks, in accordance with the side of the sink at which the eyewash unit is to be mounted. The set screw projects into the selected track for engaging the edges of thereof which define stops to limit the range of permitted valve spool rotation. The set screw additionally retains the valve spool vertically within the valve body.

In operation, the swing arm with spray heads thereon is normally disposed in an out-of-the-way position alongside the sink, with the valve spool rotationally oriented within the valve body such that the inlet port in the valve spool is misaligned with the inlet fitting in the valve body. When use of the eyewash unit is required, rotation of the swing arm from the stored out-of-the-way position to an active position with the spray heads over the sink is accompanied by alignment of the valve spool inlet port with the inlet fitting for water supply to the spray heads. The particular arc of permitted swing arm rotation, for left- or right-hand installation relative to the sink, is quickly and easily selected by advancement of the set screw into the appropriate cam track.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 2 is a fragmented top plan view of the eyewash unit and sink shown in FIG. 1;

FIG. 4 is a fragmented horizontal sectional view taken generally on the line 4—4 of FIG. 3, and showing a water flow control valve in an open position;

FIG. 5 is a fragmented sectional view similar to FIG. 4, but showing the control valve in a closed position;

DETAILED DESCRIPTION OF THE PREFERRED EMBODIMENT

Figure 1:
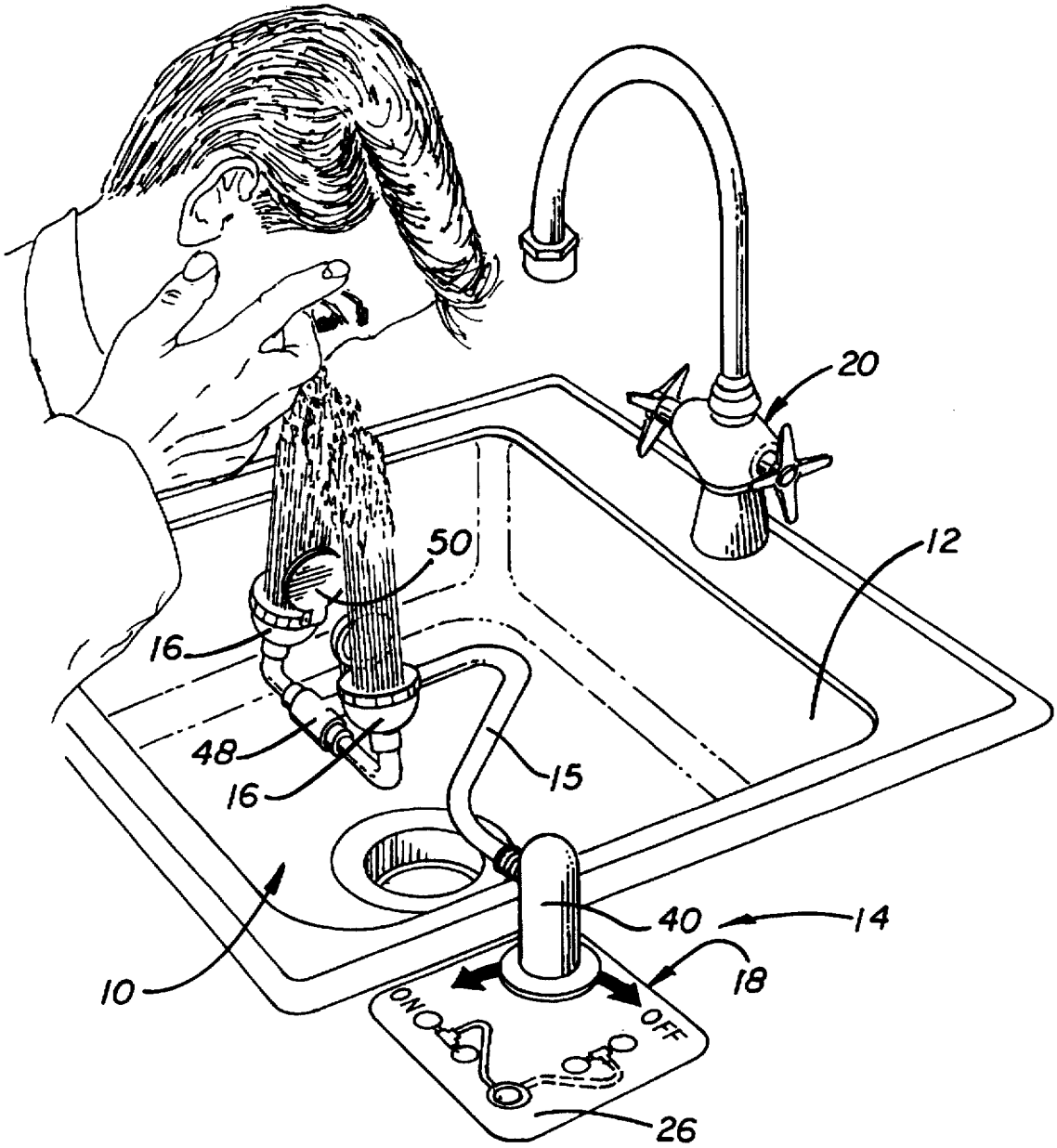
FIG. 1 is a fragmented perspective view showing the emergency eyewash unit of the present invention mounted alongside a sink.
Figure 3:
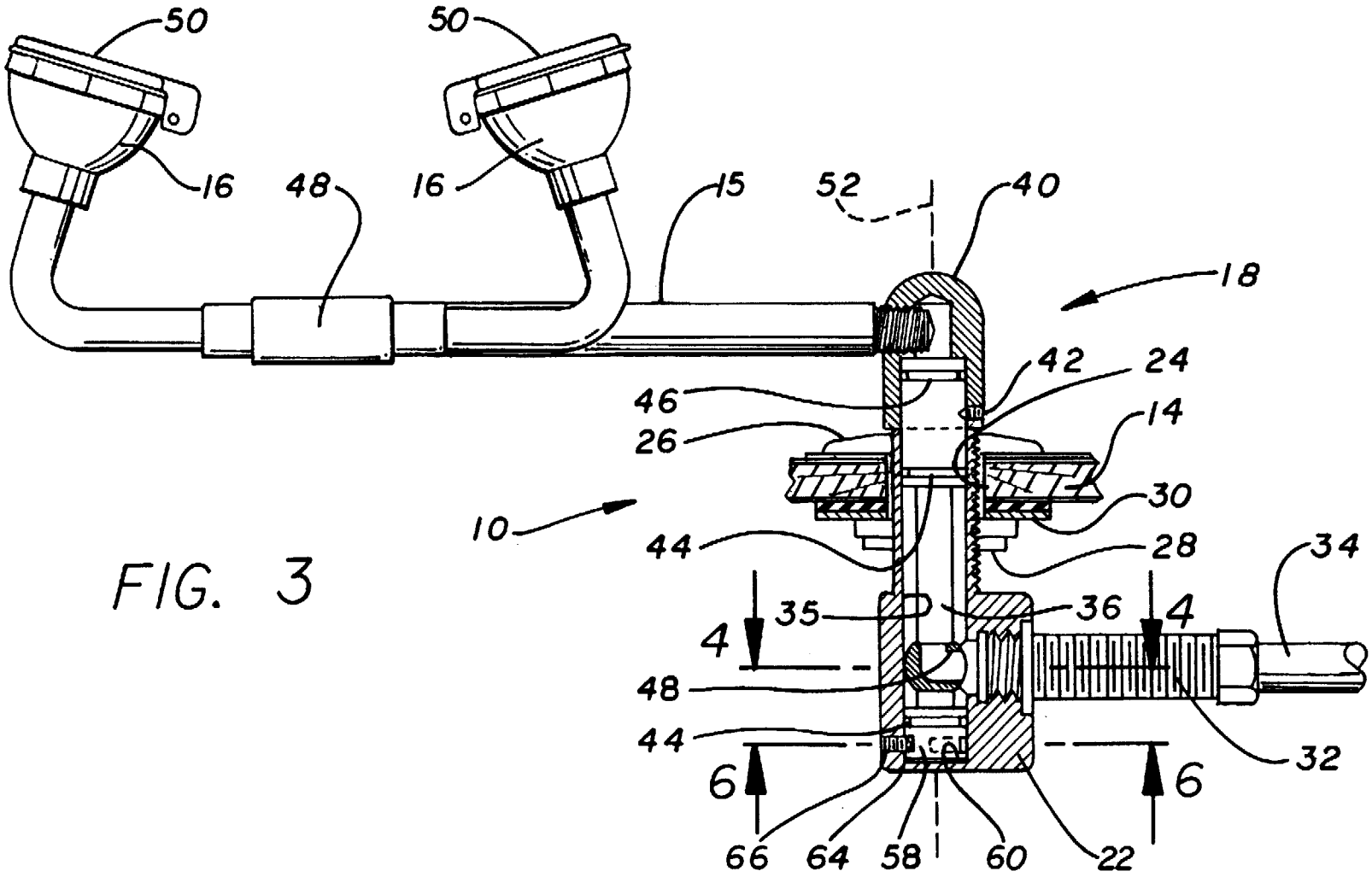
FIG. 3 is an enlarged fragmented vertical sectional view taken generally on the line 3—3 of FIG. 2.

As shown in the exemplary drawings, an improved emergency eyewash unit referred to generally by the reference numeral 10 in FIG. 1 is provided for installation alongside a sink or basin 12 or the like. The eyewash unit 10 is designed for mounting onto the counter top 14 next to the sink 12, and includes a swing arm 15 adapted for swinging movement between a stored position shown in dotted lines and an active position shown in solid lines in FIG. 2. In the active position, a pair of spray heads 16 mounted on the swing arm 15 are coupled to a flow of water to flush contaminants from the eyes and face of a person using the eyewash unit. In accordance with the invention, the eyewash unit 10 is constructed for reversible installation at the left- or right-hand side of the sink, as may be desired in a particular application.

The emergency eyewash unit 10 of the present invention is primarily intended for use in a laboratory or industrial environment as a safety measure to flush toxic substances from the eyes and face of a person, in the event of accidental substance contact with the person's eyes and face. The spray heads 16 provide a substantial yet gentle flushing flow of water which can be activated quickly and easily. In the present invention, the swing arm 15 is mounted pivotally to the counter top 14 by means of a control valve assembly 18 which automatically couples the spray heads 16 to the flushing flow of water when the swing arm 15 is moved to the active position, and which shuts off the water flow when the swing arm 15 is returned to the stored position. In the stored position, the eyewash unit 10 has a relatively low profile configuration to avoid interfering with other normal use of the sink 14 which typically includes a standard hot and cold water supply faucet set 20.

FIGS. 1–6 show the eyewash unit 10 mounted on the counter top 14 at the right-hand side of the sink 12. As shown best in FIGS. 2 and 3, the unit 10 is mounted by means of the control valve assembly 18 which includes a valve body 22 for secure mounting within and through an open passage 24 formed in the counter top 14. More particularly, the valve body 22 has an upper portion to fit through the counter top passage 24 and is externally threaded for secure attachment to the counter top 14 by means of an upper thread-on mounting plate 26 and a lower threaded nut 28 with appropriate washers 30. The mounting plate 26 is thus exposed at the upper side of the counter top 14 and desirably includes written and/or pictorial directions for use of the eyewash unit, as will be described in more detail. The upper portion of the valve body 22 merges with a lower block portion including a laterally oriented inlet fitting 32 for suitable attachment beneath the counter top 14 to a water supply line 34.

The valve body 22 defines a hollow cylindrical interior 35 having a closed lower end and an open upper end disposed above the counter top 14. A valve spool 36 forming a part of the control valve assembly is provided for simple slide-fit reception into the valve body 22. The valve spool 36 has a tubular shape with a laterally or radially open inlet port 38 formed near the lower end thereof for selective rotational alignment in an open position with the inlet fitting 32. During such alignment, water can flow from the inlet port 38 upwardly through the valve spool 36 in a direction upwardly to the swing arm 15. In this regard, the swing arm 15 includes a downwardly open cap 40 at an upstream end thereof for slide-fit mounting over the upper end of the valve spool 36 and attachment thereto by means of a set screw 42 or the like. Seal rings 44 prevent bypass leakage between the valve spool 36 and the valve body 32, and an additional seal ring 46 prevents leakage between the valve spool 36 and the swing arm cap 40.

The swing arm 15 comprises a hollow tubular element extending outwardly from the valve spool 36 and the cap 40, with a selected and typically curved geometry leading to a short manifold segment 48 which splits the water flow for passage to the pair of spray heads 16. Flow control or regulator devices may be conveniently included with or coupled to the manifold segment 48, if desired. As shown, these spray heads 16 are oriented to discharge water upwardly and angularly inwardly toward each other, for optimal flushing of toxic substances from a person's eyes. Pop-off caps 50 are normally provided on the spray heads 16 to cover and protect the heads prior to use, but wherein these pop-off caps 50 are designed to open in response to water flow to the spray heads.

The swing arm 15 with spray heads 16 thereon is thus mounted by the cap 40 and the valve spool 36 for rotation relative to the valve body 22 and the counter top 14, about a vertical axis defined by a vertical center axis 52 (FIG. 3) of the valve body 22. Importantly, the valve spool 36 is oriented in the open position within the valve body 22 so that the inlet port 38 is aligned with the inlet fitting 32, to permit water flow to and through the swing arm 15 to the spray heads 16, when and if the swing arm 15 is rotated to the active position with the spray heads 16 located over the sink 12. A resilient annular valve seat 54 (FIGS. 3–5) is interposed between-the inlet port 38 and the inlet fitting 32 to sealingly engage a convex segment on the valve spool 36 to prevent water flow to the inlet port 38, whenever the valve spool is in a closed position with the inlet port misaligned with the inlet fitting 32, when the swing arm 15 is place in the stored out-of-the-way position alongside the sink 12.

The control valve assembly 18 additionally includes means for limiting the range of pivot motion of the swing arm 15 relative to the counter top 14 and the sink. More particularly, with reference to FIGS. 3 and 6, the lower end of the valve spool 36 includes a cam segment 58 adapted to fit into a shallow cavity 60 formed in the lower end of the valve body 22 interior at a location below the inlet fitting 32. The valve spool cam segment 58 has a pair of radially outwardly open cam tracks 62 formed therein in diametrically opposed positions, each defining an arcuate span of about ninety degrees. A set screw 66 is mounted within one of a pair of threaded ports formed in the valve body 22 with an arcuate spacing therebetween of about ninety degrees relative to the center axis 52. The set screw 66 is advanced within the selected threaded port to protrude into the associated one of the advanced cam tracks 62.

Figure 6:
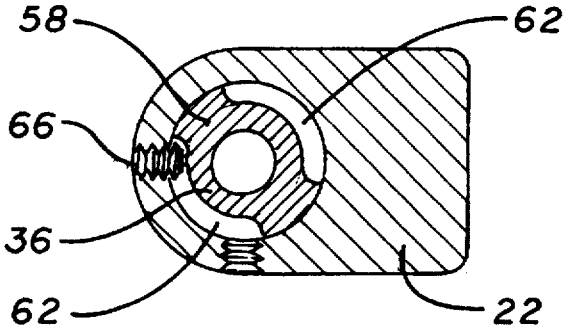
FIG. 6 is a fragmented horizontal sectional view taken generally on the line 6—6 of FIG. 3, and showing the eyewash unit configured for mounting at the right side of the sink.

In use, the set screw 66 is advanced to project into the associated cam track 62, wherein the set screw 66 is threaded into a selected one of the two threaded ports according to the left- or right-hand mounting position of the eyewash unit 10 relative to the sink 12. More specifically, as shown in FIG. 6, advancement of the set screw 66 provides a structure engaged by the radially projecting side edges of the cam track 62 as the valve spool 36 and swing arm 15 attached thereto are rotated together through an angle of about ninety degrees. One stop or end limit of the rotational movement is defined by the stored position shown in dotted lines in FIG. 2 with the set screw 66 contacting one end stop of the cam track 62, wherein this position is accompanied by the water supply turned off by misalignment between the valve spool inlet port 38 and the valve body inlet fitting 32. The other stop or opposite end of rotational movement is defined by the active position shown in solid lines in FIG. 2 with the set screw 66 contacting the opposite end stop of the cam track 62, and with the water supply turned on by alignment of the inlet port 38 with the inlet fitting 32. FIG. 1 shows, of course, installation of the eyewash unit 10 at the right-hand side of the sink 12.

Figure 8:
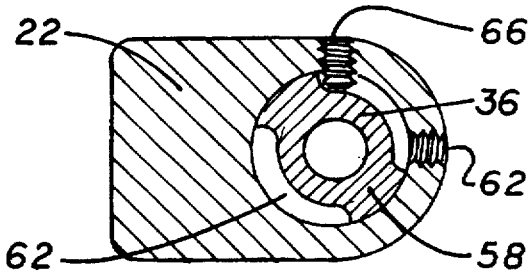
FIG. 8 is a fragmented sectional view similar to FIG. 6, but showing the eyewash unit configured for mounting at the left side of the sink.
Figure 7:
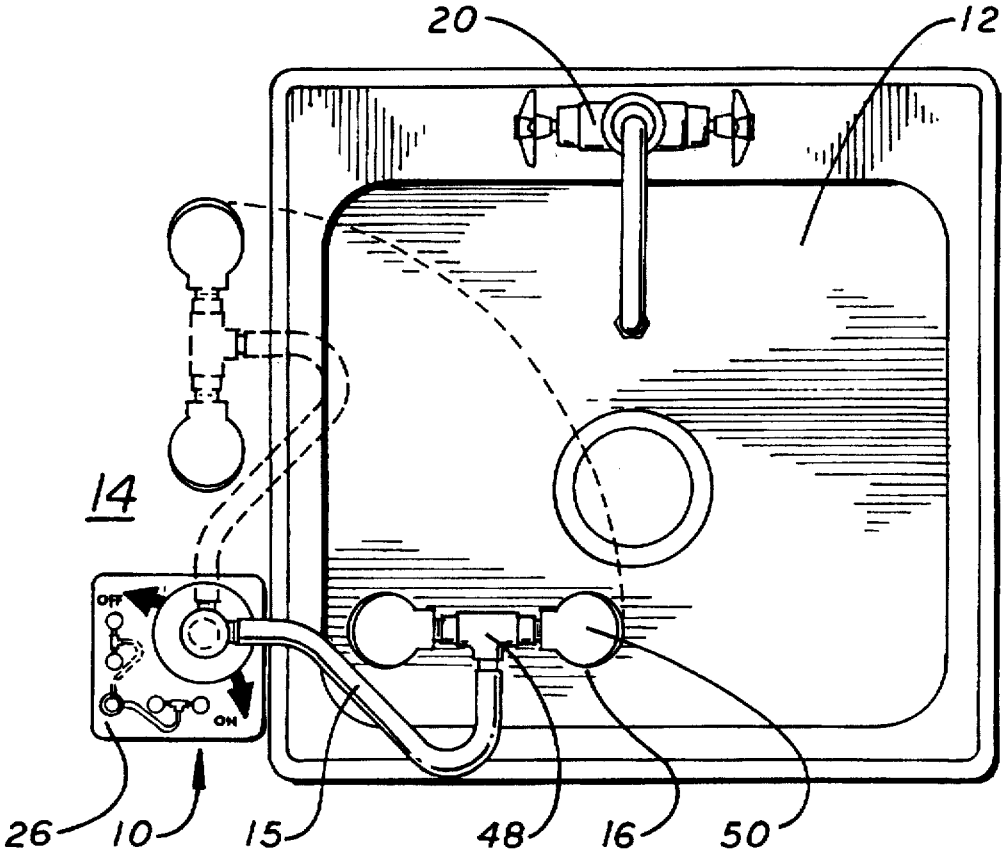
FIG. 7 is a top plan view similar to FIG. 2 and depicting installation of the eyewash unit at the left side of the sink.

Alternative configuration of the eyewash unit 10 for installation at the left-hand side of the sink 12 is accompanied by positioning the set screw 66 within the opposite threaded port as viewed in FIGS. 6 and 7. That is, the set screw 66 is advanced within the other threaded port to protrude into the other associated cam track 62 as viewed in FIG. 8. With this configuration, and with the orientation of the valve body 22 reversed as shown in FIG. 8 for left-hand mounting, the valve spool 36 and swing arm 15 are supported for part-circle movement between the active and stored positions at the opposite side of the sink. In FIG. 7, the swing arm 15 is rotated from the open active position to the closed stored position in a direction opposite to the corresponding functional movement when the eyewash unit 10 is mounted at the right-hand side of the sink 12.

Accordingly, the eyewash unit 10 of the present invention is designed for installation at either the left- or right-hand side of a sink 12, as may be necessary or desirable to suit a particular installation environment. This reversible installation capability is accomplished by simple set screw adjustment, without requiring any significant disassembly and re-assembly of components. Advancement of the set screw 66 into the associated cam track 62 retains the valve spool 36 within the valve body 22, by engaging a rim 64 at the bottom of each cam track 62, whereas retraction of the set screw 66 releases the valve spool 36 for lift-out removal from the valve body.

A variety of further modifications and improvement to the emergency eyewash unit 10 of the present invention will be apparent to those persons skilled in the art. As one example, a pair of set screws can be received within the pair of threaded ports, and a selected one of the set screws can be advanced to protrude into the associated cam track 62 according to the left- or right-hand positioning of the eyewash unit 10 on the sink, and wherein the other set screw is retracted from its associated cam track. Accordingly, no limitation on the invention is intended by way of the foregoing description and accompanying drawings, except as set forth in the appended claims.

What is claimed is:

1. An emergency eyewash unit for mounting on a counter top at a selected one of the left- and right-hand sides of a sink, said eyewash unit comprising:

a control valve assembly including a valve body adapted for connection to a water supply line and further adapted for mounting to the counter top, said control valve assembly further including a valve spool rotatably carried by said valve body, said valve spool including a radially open inlet port and being rotatable within said valve body to an open position with said inlet port oriented to permit water flow from the water supply line into said valve spool;

a tubular swing arm having one end connected in flow communication with said valve spool to receive water flow therefrom, and an opposite end connected in flow communication to at least one spray head; and cam means cooperatively engaged between said valve body and said valve spool and including adjustable set screw means for limiting the rotational range of movement of said valve spool to a selected one of at least two different arcuate paths each including said valve spool open position.

2. The emergency eyewash unit of claim 1 wherein said control valve assembly further includes means for mounting said valve body on a counter top.

3. The emergency eyewash unit of claim 1 wherein said valve body includes an inlet fitting for connection to a water supply line.

4. The emergency eyewash unit of claim 3 wherein said control valve assembly further includes a resilient valve seat interposed between said inlet fitting and said valve spool to permit water flow from said inlet fitting through said inlet port when said valve spool is in said open position, and to prevent water flow from said inlet fitting through said inlet port when said inlet port is misaligned with said inlet fitting.

5. The emergency eyewash unit of claim 1 wherein said valve body defines an upwardly open hollow interior for slide-fit reception of said valve spool, said valve spool having an upper end protruding from said valve body.

6. The emergency eyewash unit of claim 5 wherein said one end of said swing arm includes a downwardly open cap connected to said upper end of said valve spool.

7. The emergency eyewash unit of claim 1 wherein said opposite end of said swing arm is connected to a tubular manifold segment having a pair of spray heads mounted thereon in flow communication with said swing arm.

8. The emergency eyewash unit of claim 1 wherein said cam means comprises a pair of cam tracks of part-circle arcuate shape formed in said valve spool, and wherein said set screw means comprises at least one set screw threadably carried by said valve body for threaded advancement to protrude into a selected one of said pair of cam tracks.

9. The emergency eyewash unit of claim 8 wherein each of said cam tracks has an arcuate span of about ninety degrees.

10. An emergency eyewash unit for mounting on a counter top at a selected one of the left- and right-hand sides of a sink, said eyewash unit comprising:

a control valve assembly including a valve body adapted for connection to a water supply line and further adapted for mounting to the counter top, said control valve assembly further including a valve member carried by said valve body for rotation between open and closed positions;

a tubular swing arm having one end connected to said valve member and an opposite end having at least one spray head mounted thereon, said swing arm being movable manually to rotate said valve member between said open and closed positions for respectively permitting and preventing water flow through said control valve assembly to said swing arm and at least one spray head mounted thereon; and cam means cooperatively engaged between said valve body and said valve member and including adjustable set screw means for limiting the rotational range of movement of said valve member to a selected one of at least two different arcuate paths each including said valve member open position.

11. An emergency eyewash unit for mounting on a counter top at a selected one of the left- and right-hand sides of a sink, said eyewash unit comprising:

a control valve assembly including a valve body having an inlet fitting adapted for connection to a water supply line, means for connecting said valve body to a counter top, and a valve spool rotatably mounted within said valve body and having a radially open inlet port formed therein, said valve spool being rotatable within said valve body to an open position with said inlet port generally aligned with said inlet fitting to permit water flow from said inlet fitting through said inlet port into said valve spool, and a closed position with said inlet port misaligned with said inlet fitting to prevent water flow from said inlet fitting into said valve spool; a tubular swing arm having one end connected in flow communication with said valve spool to receive water flow therefrom, and an opposite end having at least one spray head mounted thereon; and cam means for limiting the rotational range of movement of said valve spool within said valve body, said cam means including a pair of arcuate part-circle cam tracks formed in said valve spool, a pair of threaded set screw ports formed in said valve body in respective alignment with said pair of cam tracks, and at least one set screw for threaded mounting in a selected one of said set screw ports and threaded advancement therein to protrude into the associated selected one of said cam tracks, whereby opposite ends of the associated selected one of said cam tracks are engageable with said protruding set screw to define opposite end limits of rotation for said valve spool, and further wherein each of said cam tracks permits rotation of said valve spool to said open position.

12. The emergency eyewash unit of claim 11 wherein said control valve assembly further includes a resilient valve seat interposed between said inlet fitting and said valve spool.

13. The emergency eyewash unit of claim 11 wherein said opposite end of said swing arm is connected to a tubular manifold segment having a pair of spray heads mounted thereon.

14. The emergency eyewash unit of claim 11 wherein each of said cam tracks has an arcuate span of about ninety degrees.

* * * * *